US009947258B2

(12) United States Patent
Zhao et al.

(10) Patent No.: US 9,947,258 B2
(45) Date of Patent: Apr. 17, 2018

(54) IMAGE PROCESSING METHOD AND IMAGE PROCESSING APPARATUS

(71) Applicant: Novatek Microelectronics Corp., Hsinchu (TW)

(72) Inventors: Bo Zhao, Sichuan Province (CN); Lei Zhang, ShanXi Province (CN); Yuan-Jia Du, Shangdong Province (CN); Yen-Tao Liao, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 242 days.

(21) Appl. No.: 14/838,372

(22) Filed: Aug. 28, 2015

(65) Prior Publication Data

US 2017/0061843 A1 Mar. 2, 2017

(51) Int. Cl.
*G09G 3/20* (2006.01)

(52) U.S. Cl.
CPC ... *G09G 3/2003* (2013.01); *G09G 2300/0452* (2013.01); *G09G 2310/027* (2013.01); *G09G 2320/0233* (2013.01); *G09G 2320/0242* (2013.01); *G09G 2320/0626* (2013.01); *G09G 2340/0428* (2013.01)

(58) Field of Classification Search
None
See application file for complete search history.

(56) References Cited

U.S. PATENT DOCUMENTS

2013/0216130 A1* 8/2013 Saito ..... H04N 9/045 382/165

* cited by examiner

*Primary Examiner* — David D Davis
(74) *Attorney, Agent, or Firm* — JCIPRNET

(57) ABSTRACT

An image processing method is provided. The image processing method includes: performing dynamic brightness control on an input image to determine a brightness gain for the input image; performing texture analysis on the input image based on blocks to determine filter indexes for the input image; performing color conversion with edge protection on the input image according to the brightness gain; and performing sub-pixel adjustment on the input image according to the filter indexes and a pixel arrangement of a display panel, so as to output an output image. An image processing apparatus is also provided.

18 Claims, 5 Drawing Sheets

IMAGE PROCESSING METHOD AND IMAGE PROCESSING APPARATUS

BACKGROUND OF THE INVENTION

1. Field of the Invention

The invention generally relates to an image processing method and an image processing apparatus, in particular, to an image processing method and an image processing apparatus of sub-pixel rendering.

2. Description of Related Art

With the blooming development in display technology, the market demands for perfoiniance requirements of a sub-pixel rendering are advancements in high resolution, high brightness and low-power consumption. However, with increases in resolution of the display panel, because the amount of sub-pixels on the display panel also increases in order to display in high resolution, manufacturing cost is also increased accordingly. In order to increase the transmittance of the display panel, a sub-pixel rendering method has been developed. A display apparatus generally uses different arrangements and designs of the sub-pixels to foimulate a proper algorithm so that the resolution may be increased to a sub-pixel resolution when an image is displayed. Because the size of the sub-pixel is smaller than that of a pixel, the resolution that is visible by human eye (i.e., a visual resolution) may be increased. Further, from the perspective of display quality, a proper image processing method is necessary based on requirements in practical applications. A more preferable user experience may be provided if the display apparatus is capable of continuously providing a favorable display quality.

SUMMARY OF THE INVENTION

The invention is directed to an image processing method and an image processing apparatus, which are capable of providing good image display quality on a display panel.

Accordingly, the invention is directed to an image processing method. The image processing method includes: performing dynamic brightness control on an input image to determine a brightness gain for the input image; performing texture analysis on the input image based on blocks to determine filter indexes for the input image; perfouning color conversion with edge protection on the input image according to the brightness gain; and performing sub-pixel adjustment on the input image according to the filter indexes and a pixel arrangement of a display panel, so as to output an output image.

In an exemplary embodiment of the invention, the step of performing the dynamic brightness control on the input image includes: converting the input image of a first color space to the input image of a second color space; and analyzing the input image of the second color space to determine the brightness gain.

In an exemplary embodiment of the invention, the step of analyzing the input image of the second color space to detennine the brightness gain includes: grouping pixel values of the input image of the second color space based on a color parameter of the second color space into a plurality of sections; and determining a color gain and a gain weight of each of the sections based on the color parameter to calculate the brightness gain.

In an exemplary embodiment of the invention, the input image includes a plurality of pixels. The step of performing the color conversion with the edge protection on the input image includes: performing the color conversion on the input image to convert the input image of a first color type into the input image of a second color type; calculating a first gain and a second gain of each of the pixels, wherein at least one of the first gain and the second gain is calculated according to the brightness gain; performing the edge protection on the first gain and the second gain of each of the pixels to obtain the first gain and the second gain, on which the edge protection has been performed; and calculating output pixel values of each of the pixels according to the obtained first gain, the obtained second gain, and input pixel values of each of the pixels.

In an exemplary embodiment of the invention, before the color conversion is perfollned on the input image, each of the pixels of the input image of the first color type comprises a red sub-pixel, a blue sub-pixel and a green sub-pixel. After the color conversion is performed on the input image, each of the pixels of the input image of the second color type comprises the red sub-pixel, the blue sub-pixel, the green sub-pixel and a white sub-pixel.

In an exemplary embodiment of the invention, the input image includes a plurality of blocks. Each of the blocks comprises a plurality of pixels. The step of performing the texture analysis on the input image based on blocks includes: determining the filter indexes of the pixels for each of the blocks according to a target pixel of the pixels and a gradient around the target pixel.

In an exemplary embodiment of the invention, in the step of determining the filter indexes of the pixels for each of the blocks, a first filter is selected to smooth the target pixel if the target pixel is near an edge, and a second filter is selected to sharp the target pixel if the target pixel is located in a smooth region.

In an exemplary embodiment of the invention, the step of performing the sub-pixel adjustment on the input image includes: performing sub-pixel up-scaling on the input image according to the filter indexes; and performing sub-pixel down-sampling on the input image according to the pixel arrangement of the display panel, so as to output the output image.

In an exemplary embodiment of the invention, each of the filter indexes is corresponding to a group of filters. The group of filters includes a plurality of poly-phase filters. The step of performing the sub-pixel up-scaling on the input image includes: determining a phase number of a first direction and a phase number of a second direction for each of the poly-phase filters; and performing the sub-pixel up-scaling on the input image in the first direction and the second direction according to the phase number of the first direction and the phase number of the second direction.

In an exemplary embodiment of the invention, pixels of the display panel are arranged for sub-pixel rendering. After the step of performing the sub-pixel down-sampling on the input image is performed, the output image is outputted, and the output image fits the pixel arrangement of the display panel.

Accordingly, the invention is directed to an image processing apparatus. The image processing apparatus includes a processor unit. The processor unit perfomis dynamic brightness control on an input image to determine a brightness gain for the input image. The processor unit performs texture analysis on the input image based on blocks to determine filter indexes for the input image. The processor unit performs color conversion with edge protection on the input image according to the brightness gain. The processor unit perfoinis sub-pixel adjustment on the input image according to the filter indexes and a pixel arrangement of a display panel, so as to output an output image.

In an exemplary embodiment of the invention, when the processor unit performs the dynamic brightness control on the input image, the processor unit converts the input image of a first color space to the input image of a second color space, and analyses the input image of the second color space to determine the brightness gain.

In an exemplary embodiment of the invention, when the processor unit analyses the input image of the second color space to determine the brightness gain, the processor unit groups pixel values of the input image of the second color space based on a color parameter of the second color space into a plurality of sections, and determines a color gain and a gain weight of each of the sections based on the color parameter to calculate the brightness gain.

In an exemplary embodiment of the invention, the input image includes a plurality of pixels. When the processor unit performs the color conversion with the edge protection on the input image, the processor unit perfornis the color conversion on the input image to convert the input image of a first color type into the input image of a second color type, the processor unit calculates a first gain and a second gain of each of the pixels gain, the processor unit performs the edge protection on the first gain and the second gain of each of the pixels to obtain the first gain and the second gain, on which the edge protection has been performed, and the processor unit calculates output pixel values of each of the pixels according to the obtained first gain, the obtained second gain, and input pixel values of each of the pixels. At least one of the first gain and the second gain is calculated according to the brightness gain.

In an exemplary embodiment of the invention, before the color conversion is performed on the input image, each of the pixels of the input image of the first color type includes a red sub-pixel, a blue sub-pixel and a green sub-pixel. After the color conversion is performed on the input image, each of the pixels of the input image of the second color type includes the red sub-pixel, the blue sub-pixel, the green sub-pixel and a white sub-pixel.

In an exemplary embodiment of the invention, the input image includes a plurality of blocks. Each of the blocks includes a plurality of pixels. When the processor unit perfoinis the texture analysis on the input image based on blocks, the processor unit determines the filter indexes of the pixels for each of the blocks according to a target pixel of the pixels and a gradient around the target pixel.

In an exemplary embodiment of the invention, when the processor unit determines the filter indexes of the pixels for each of the blocks, a first filter is selected to smooth the target pixel if the target pixel is near an edge, and a second filter is selected to sharp the target pixel if the target pixel is located in a smooth region.

In an exemplary embodiment of the invention, when the processor unit performs the sub-pixel adjustment on the input image, the processor unit performs sub-pixel up-scaling on the input image according to the filter indexes, and the processor unit performs sub-pixel down-sampling on the input image according to the pixel arrangement of the display panel, so as to output the output image.

In an exemplary embodiment of the invention, each of the filter indexes is corresponding to a group of filters. The group of filters includes a plurality of poly-phase filters. When the processor unit performs the sub-pixel up-scaling on the input image, the processor unit determines a phase number of a first direction and a phase number of a second direction for each of the poly-phase filters, and the processor unit performs the sub-pixel up-scaling on the input image in the first direction and the second direction according to the phase number of the first direction and the phase number of the second direction.

In an exemplary embodiment of the invention, pixels of the display panel are arranged for sub-pixel rendering, and after the processor unit performs the sub-pixel down-sampling on the input image, the output image is outputted, and the output image fits the pixel arrangement of the display panel.

Based on the above, in the exemplary embodiments of the invention, the color conversion with edge protection is performed according to the brightness gain, and the sub-pixel adjustment is perfonned according to the filter indexes and the pixel arrangement of the display panel. Therefore, the image processing method and the image processing apparatus are capable of providing good image display quality.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
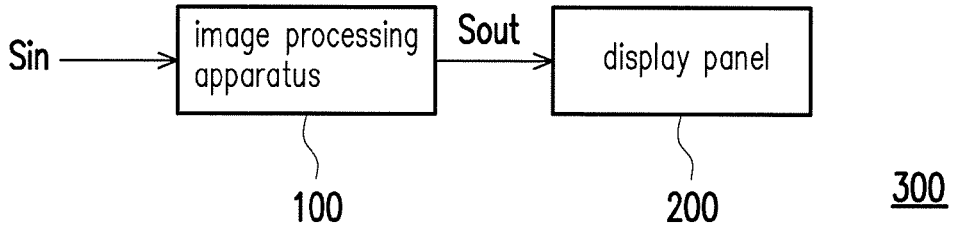
FIG. 1 illustrates a block diagram of an image display apparatus according to an embodiment of the invention.

Reference will now be made in detail to the present preferred embodiments of the invention, and examples of which are illustrated in the accompanying drawings. Wherever possible, the same reference numbers are used in the drawings and the description to refer to the same or like parts.

Figure 2:
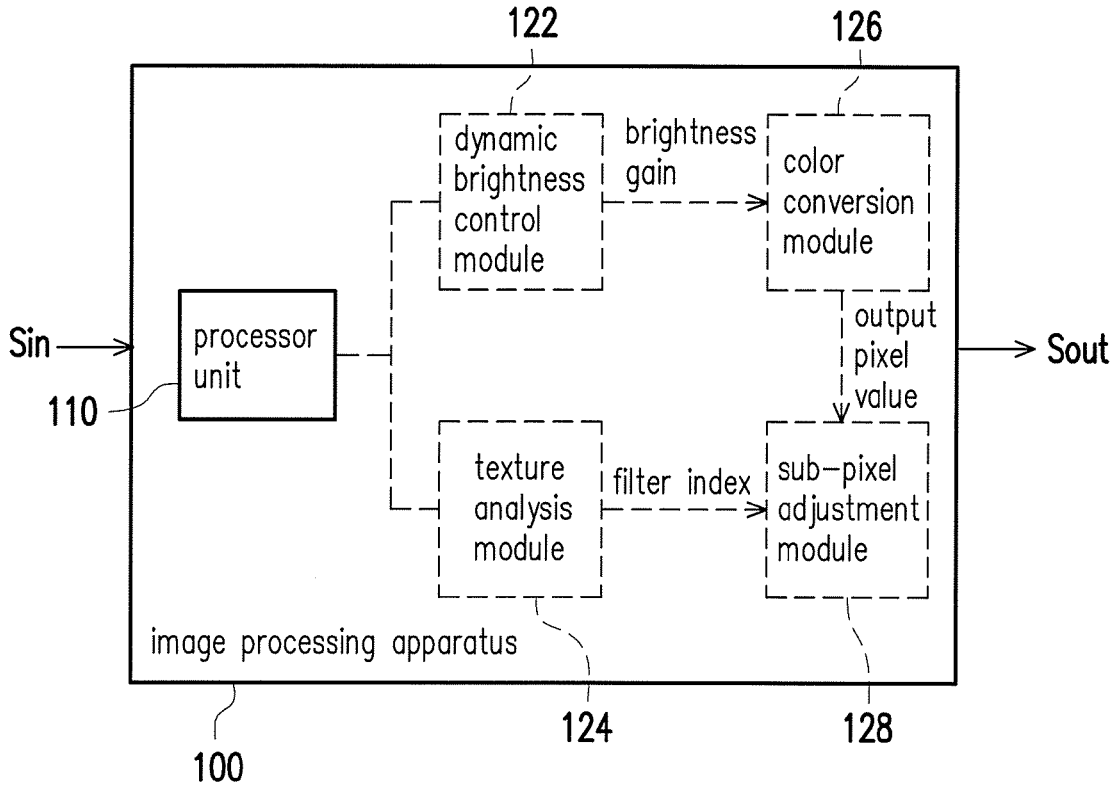
FIG. 2 illustrates a block diagram of an image processing apparatus according to an embodiment of the invention.

FIG. 1 illustrates a block diagram of an image display apparatus according to an embodiment of the invention. FIG. 2 illustrates a block diagram of an image processing apparatus according to an embodiment of the invention. Referring to FIG. 1 and FIG. 2, the image display apparatus 300 may include an image processing apparatus 100 and a display panel 200. In this embodiment, the image processing apparatus 100 may include a processor unit 110 and multiple image processing modules to perform an exemplary image processing method of the invention. The image processing apparatus 100 may be configured to process at least one input image Sin by using the exemplary image processing method, so as to output an output image Sout to drive the display panel 200. The input image Sin may be an original image of red colors, green colors and blue colors, i.e. an original RGB image, and the output image Sout may be a processed image of red colors, green colors, blue colors and white colors, i.e. a processed RGBW image in this embodiment, but the invention is not limited thereto. Furthermore, pixels of the display panel 200 may be arranged for sub-pixel rendering, and various pixel arrangements may be implemented for the display panel 200 in exemplary embodiments of the invention.

In the embodiment, the multiple image processing modules may include a dynamic brightness control module 122, a texture analysis module 124, a color conversion module 126 and a sub-pixel adjustment module 128. These multiple image processing modules may be implemented by software, hardware or firmware. The processor unit 110 may derive, control or read the multiple image processing modules to perform the image processing method. Herein, the multiple image processing modules may be implemented by software for example, but the invention is not limited thereto. On the other hand, the processor unit 110 may include a single processor or multiple processors to perform the exemplary image processing method, but the number of the processors does not limit the invention. In the present embodiment, the processor unit 110 is, for example, a micro-controller unit (MCU), a central processing unit (CPU), or other microprocessor, a digital signal processor (DSP), a programmable controller, application specific integrated circuits (ASIC), a programmable logic device (PLD), or other similar devices.

Figure 3:
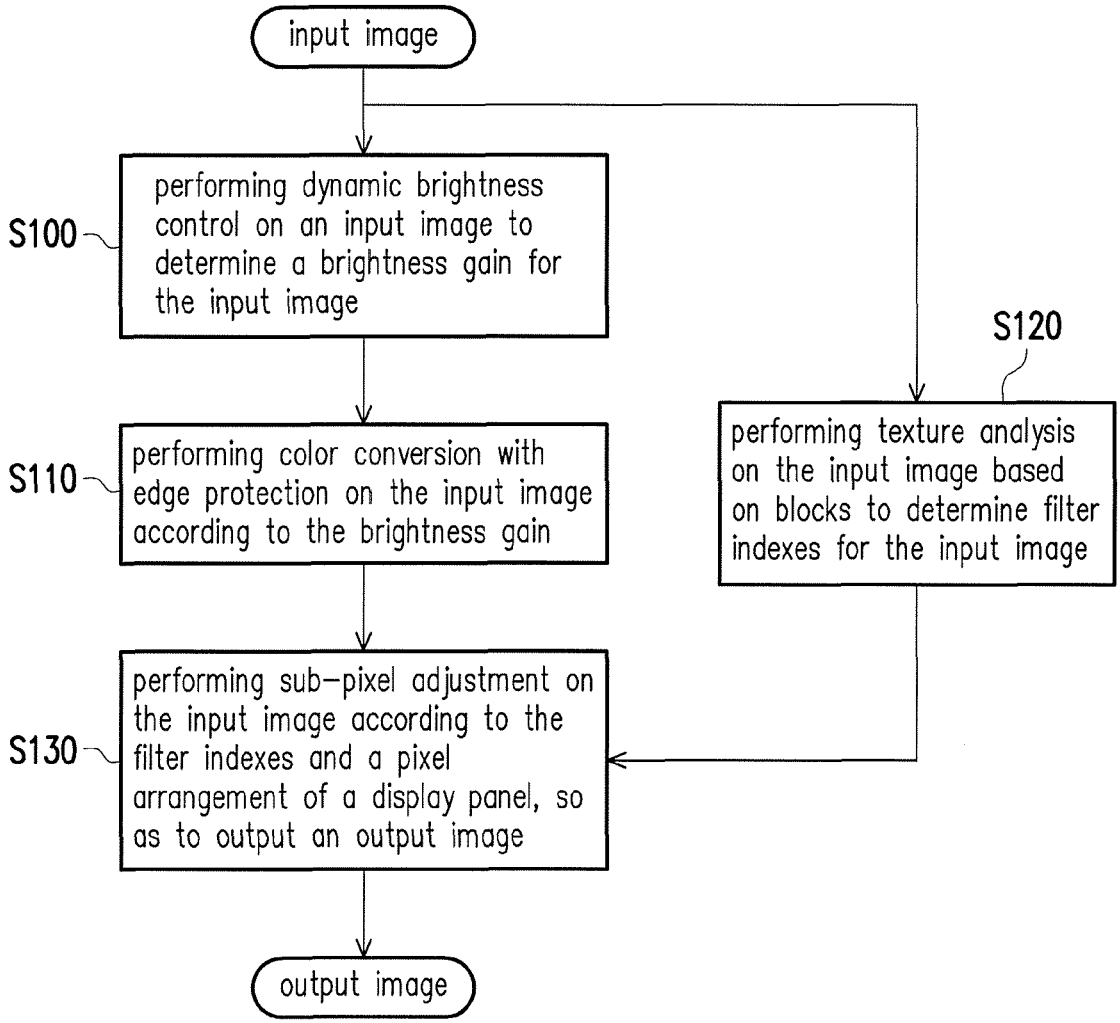
FIG. 3 illustrates a flowchart of an image display method according to an embodiment of the invention.

FIG. 3 illustrates a flowchart of an image display method according to an embodiment of the invention. Referring to FIG. 2 and FIG. 3, the processor unit 110 may perform the image processing method by using the multiple image processing modules in this embodiment. A step of dynamic brightness control, for example, is added before a step of color conversion with edge protection in this embodiment. In step S100, the processor unit 110 performs the dynamic brightness control on the input image Sin image by image by using the dynamic brightness control module 122. The dynamic brightness control is performed to determine a brightness gain for the input image Sin in step S100. The determined brightness gain may be a gain of the whole input image Sin. For example, the processor unit 110 may analyse the distribution of the pixels' color saturation, e.g. hue, of the whole input image Sin to obtain the brightness gain. The input image Sin may be an original image of red colors, green colors and blue colors, i.e. an original RGB image, in this embodiment. The exemplary image processing method provides more realistic scenarios. Without the dynamic brightness control, the yellow color may look like khaki, for example. The processor unit 110 controls the brightness gain of the whole input image Sin by the dynamic brightness control module 122.

Next, in step S110, the processor unit 110 may perform the color conversion with the edge protection on the input image Sin according to the brightness gain determined in step S100 by using the color conversion module 126. In this embodiment, the color conversion may be first performed on the input image Sin, and then the edge protection may be further performed on the converted input image Sin according to the brightness gain, but the invention is not limited thereto. In this embodiment, the color conversion perfoiined in step S110 may be a gamut mapping operation. The input image of a first color type may be converted into the input image of a second color type. For example, before the color conversion is performed on the input image Sin, each of the pixels of the input image Sin of the first color type may include a red sub-pixel, a blue sub-pixel and a green sub-pixel. By contrast, after the color conversion is performed on the input image Sin, each of the pixels of the input image Sin of the second color type may include the red sub-pixel, the blue sub-pixel, the green sub-pixel and a white sub-pixel. Without the edge protection, the input image Sin of the second color type may cause imbalance at the edge of two colors, such as white edge, contour, or jaggy edge. The input image Sin of the second color type, e.g. the input image Sin with RGBW sub-pixel arrangement, is outputted by the color conversion module 126.

On the other hand, the processor unit 110 performs texture analysis on the input image Sin based on blocks by using the texture analysis module 124 in step S120. In this embodiment, the input image Sin may be the input image Sin of the first color type, and includes a plurality of blocks. Each of the blocks includes a plurality of pixels. In step S120, the texture around a target pixel in the block is analysed to determine filter indexes for the input image Sin. The determined filter indexes are outputted by the texture analysis module 124, and filters may be selected based on the filter indexes. The selected filters are used in step S130 for adjusting the pixels of the input image Sin, e.g. upscaling the pixels. Furthermore, although step S100 is described before step S120 in this embodiment, step S120 may be performed before, after, or at the same time as step S100, and the sequence of steps S100 and S120 does not limit the invention.

Thereafter, in step S130, the processor unit 110 performs sub-pixel adjustment on the input image Sin outputted by the color conversion module 126 according to the filter indexes and the pixel arrangement of the display panel 200 by using the sub-pixel adjustment module 128. After step S130 is completed, the output image Sout is outputted by the sub-pixel adjustment module 128 to drive the display panel 200, as shown in FIG. 1. In the exemplary embodiment, the sub-pixel adjustment in step S130 may include sub-pixel up-scaling, sub-pixel down-sampling, and the like, and the invention is not limited thereto.

Figure 4:
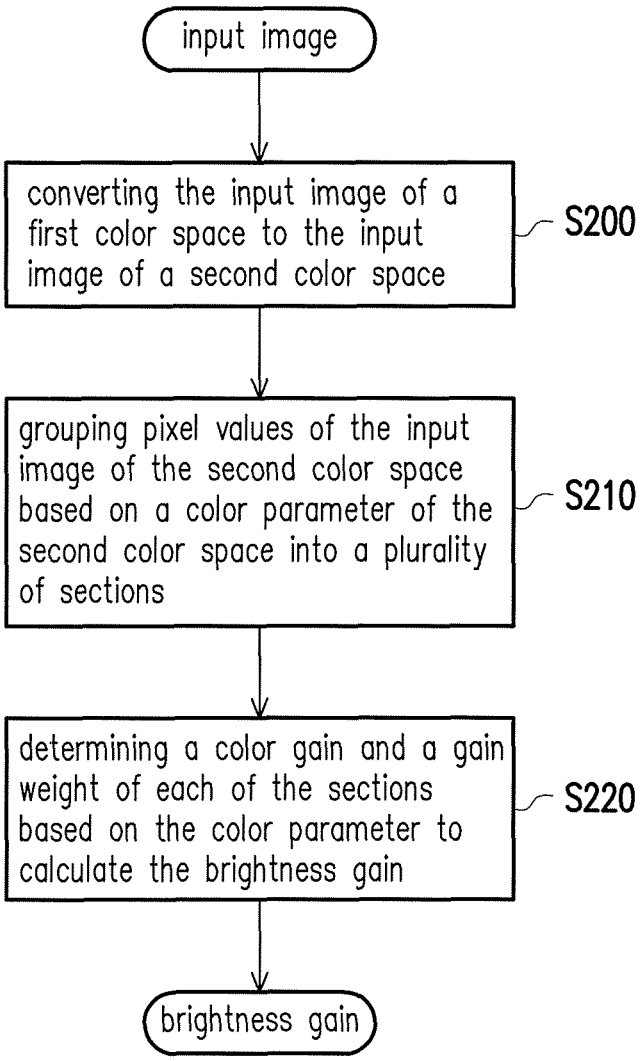
FIG. 4 illustrates a flowchart of a dynamic brightness control method according to an embodiment of the invention.

FIG. 4 illustrates a flowchart of a dynamic brightness control method according to an embodiment of the invention. Referring to FIG. 2 to FIG. 4, the processor unit 110 may perform the dynamic brightness control method by using the dynamic brightness control module 122 in this embodiment, for example. In step S100 of FIG. 3, the processor unit 110 performs the dynamic brightness control on the input image Sin image by image to determine the brightness gain for the input image Sin. In this embodiment, step S100 may include steps S200, S210 and S220 to execute the dynamic brightness control method.

In step S200, the processor unit 110 converts the input image Sin of a first color space, e.g. RGB color space, to the input image Sin of a second color space, e.g. HSV color space. Therefore, the input image Sin of the second color space may be analysed to determine the brightness gain in this embodiment. Herein, the HSV color space is exemplary for description of the second color space, and the hue histogram of the input image Sin may be analysed.

Next, in step S210, the processor unit 110 groups pixel values of the input image Sin of the second color space based on a color parameter of the second color space, e.g. the hue of the HSV color space, into a plurality of sections. For example, the region of the hue changes from 0 to 360 in the HSV color space, and the whole region may be divided into several sections, such as 36 sections. The pixel values of the input image Sin are grouped into 36 sections to obtain the hue histogram. A color gain and a gain weight of each of the sections may be determined based on the color parameter.

Thereafter, in step S220, the processor unit 110 determines a color gain and a gain weight of each of the sections based on the color parameter to calculate the brightness gain. For example, the color gain of yellow section may be set to be larger than the color gain of green section or the color gain of red section. Next, for each of the sections, the gain weight is further set for the color gain. In this embodiment, the gain weight may be set by using a preset weight table or based on the color of the section. After the color gain and the gain weight of each of the sections are determined, the brightness gain may be calculated based on a preset function, elementary arithmetic, or the like. Accordingly, the dynamic brightness control module 122 outputs the brightness gain to the color conversion module 126 for the color conversion and the edge protection. In the exemplary dynamic brightness control method of FIG. 4, the trade-off is considered between the saturation of colors and the luminance of the input image Sin, and the brightness gain is determined according to the content of the input image Sin. The brightness gain is set for the whole input image Sin and configured to control the brightness for the input image Sin. The color saturation and hue may be maintained.

Figure 5:
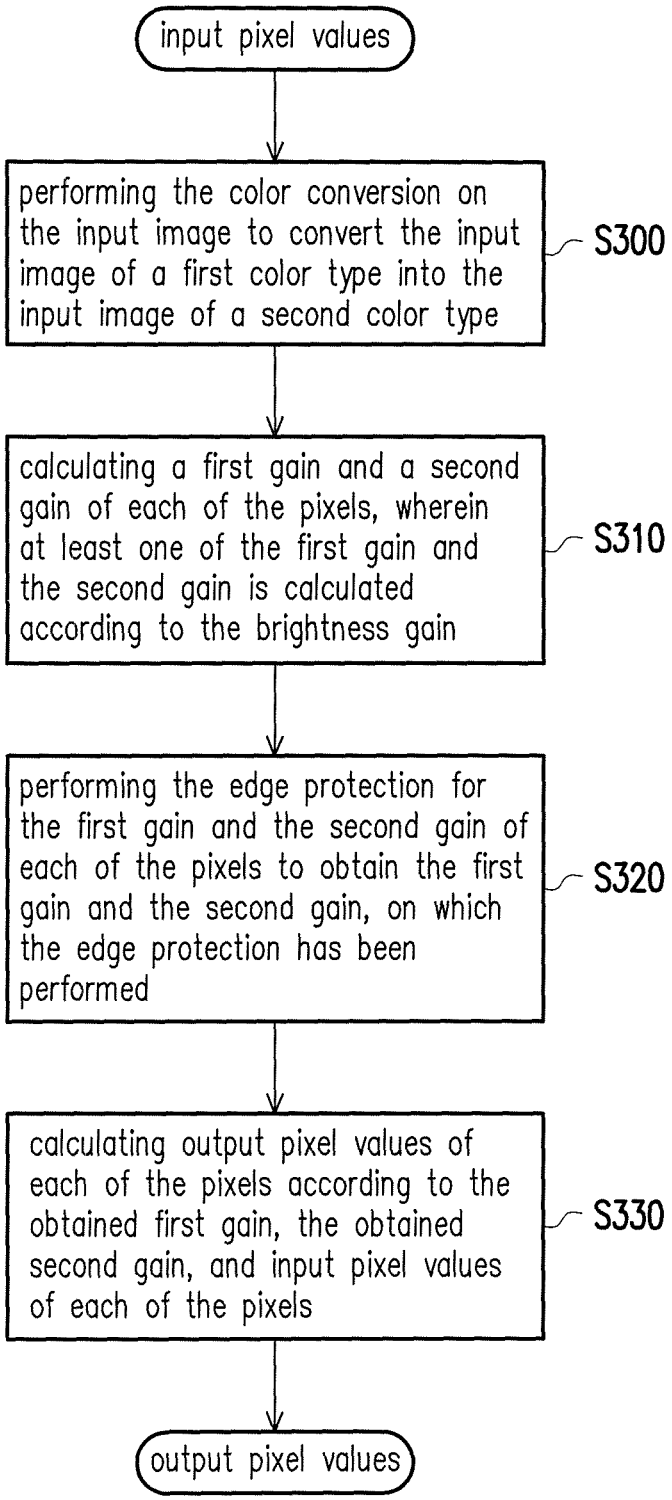
FIG. 5 illustrates a flowchart of a color conversion method with the edge protection according to an embodiment of the invention.

FIG. 5 illustrates a flowchart of a color conversion method with the edge protection according to an embodiment of the invention. Referring to FIG. 2, FIG. 3 and FIG. 5, the processor unit 110 may perform the color conversion method with the edge protection by using the color conversion module 126 in this embodiment, for example. In step S110 of FIG. 3, the processor unit 110 performs the color conversion with the edge protection on the input image Sin according to the brightness gain obtained in step S100. In this embodiment, step S110 may include steps S300, S310, S320 and S330 to execute the color conversion method with the edge protection.

In step S300, the processor unit 110 performs the color conversion on the input image Sin to convert the input image of a first color type into the input image of a second color type. In this embodiment, before the color conversion is performed on the input image, each of the pixels of the input image Sin of the first color type includes a red sub-pixel, a blue sub-pixel and a green sub-pixel. After the color conversion is performed on the input image, each of the pixels of the input image Sin of the second color type includes the red sub-pixel, the blue sub-pixel, the green sub-pixel and a white sub-pixel.

In step S310, the processor unit 110 calculates a first gain and a second gain of each of the pixels. At least one of the first gain and the second gain is calculated according to the brightness gain in this embodiment. For example, the first gain may be a white gain W_gain for each pixel. The first gain may be calculated based on input pixel values of red color, green color, and blue color, i.e. the RGB pixel values. The RGB pixel values may be the input data over the three color channels of each pixel. In one embodiment, a maximum value max_V and a minimum value min_V of the RGB pixel values are selected to calculate the first gain for each pixel, and the first gain may be calculated by a formula W_gain=min_V/(max_V+min_V), where W_gain is the first gain, max_V is the maximum value of the RGB pixel values, and min_V is the minimum value of the RGB pixel values. On the other hand, the second gain RGB_gain may be a gain of red color, green color, and blue color for each pixel, i.e. the RGB gain. The second gain may be calculated based on one of the RGB pixel values, the white gain, and the brightness gain. One available calculation for generating the second gain RGB_gain is calculated by the following formulas: RGB_gain_Thr=1+(min_V×W_gain×brightness_gain)/max_V; and RGB_gain=min(brightness_gain, RGB_gain_Thr), where W_gain is the first gain, RGB_gain is the second gain, max_V is the maximum value of the RGB pixel values, min_V is the minimum value of the RGB pixel values, and brightness_gain is the brightness gain.

That is to say, the second gain is calculated according to the brightness gain in this embodiment. In other embodiments, the first gain may also be calculated according to the brightness gain, and the invention is not limited thereto. The calculation of the first gain and the second gain may include a preset function, elementary arithmetic, or the like.

In step S320, the processor unit 110 performs the edge protection on the first gain and the second gain of each of the pixels to obtain the first gain and the second gain that the edge protection has been performed. To eliminate the contour and white edges at the junction of two colors, filtering for the first gain and the second gain in the horizontal direction or in the vertical direction may be required. The filter tap number and coefficients may be registered according to the requirement. After filtering, the first gain and the second gain that the edge protection has been performed are obtained.

In step S330, the processor unit 110 calculates output pixel values of each of the pixels according to the first gain and the second gain obtained in step S320 and input pixel values of each of the pixels. The output pixel values over the four channels of each pixel includes the red sub-pixel, the blue sub-pixel, the green sub-pixel and the white sub-pixel. For example, the output pixel value of the white sub-pixel W_out may be calculated based on the first gain, the second gain and the input pixel values of the red sub-pixel, the blue sub-pixel, the green sub-pixel, such as W_out=min(R1, G1, B1)×W_gain, where R1=R×RGB_gain, B1=B×RGB_gain, G1=G×RGB_gain; and R, B, and G are respectively the input pixel values of the red sub-pixel, the blue sub-pixel, the green sub-pixel. The output pixel value of the red sub-pixel R_out, the output pixel value of the blue sub-pixel B_out, and the output pixel value of the green sub-pixel G_out may be calculated according to the input pixel values of the red sub-pixel, the blue sub-pixel, the green sub-pixel respectively and further according to the second gain and the output pixel value of the white sub-pixel, such as R_out=R1−W_out, B_out=B1−W_out, and G_out=G1−W_out, where R1=R×RGB_gain, B1=B×RGB_gain, G1=G×RGB_gain; and R, B, and G are respectively the input pixel values of the red sub-pixel, the blue sub-pixel, the green sub-pixel. The calculation of the output pixel values may include a preset function, elementary arithmetic, or the like. In the exemplary color conversion method with the edge protection of FIG. 5, the edge protection performed during the color conversion may eliminate the edge errors at the junction of two colors, such as white edge, jaggy edge and so on. The output pixel values are outputted to the sub-pixel adjustment module 128 from the color conversion module 126.

Figure 6:
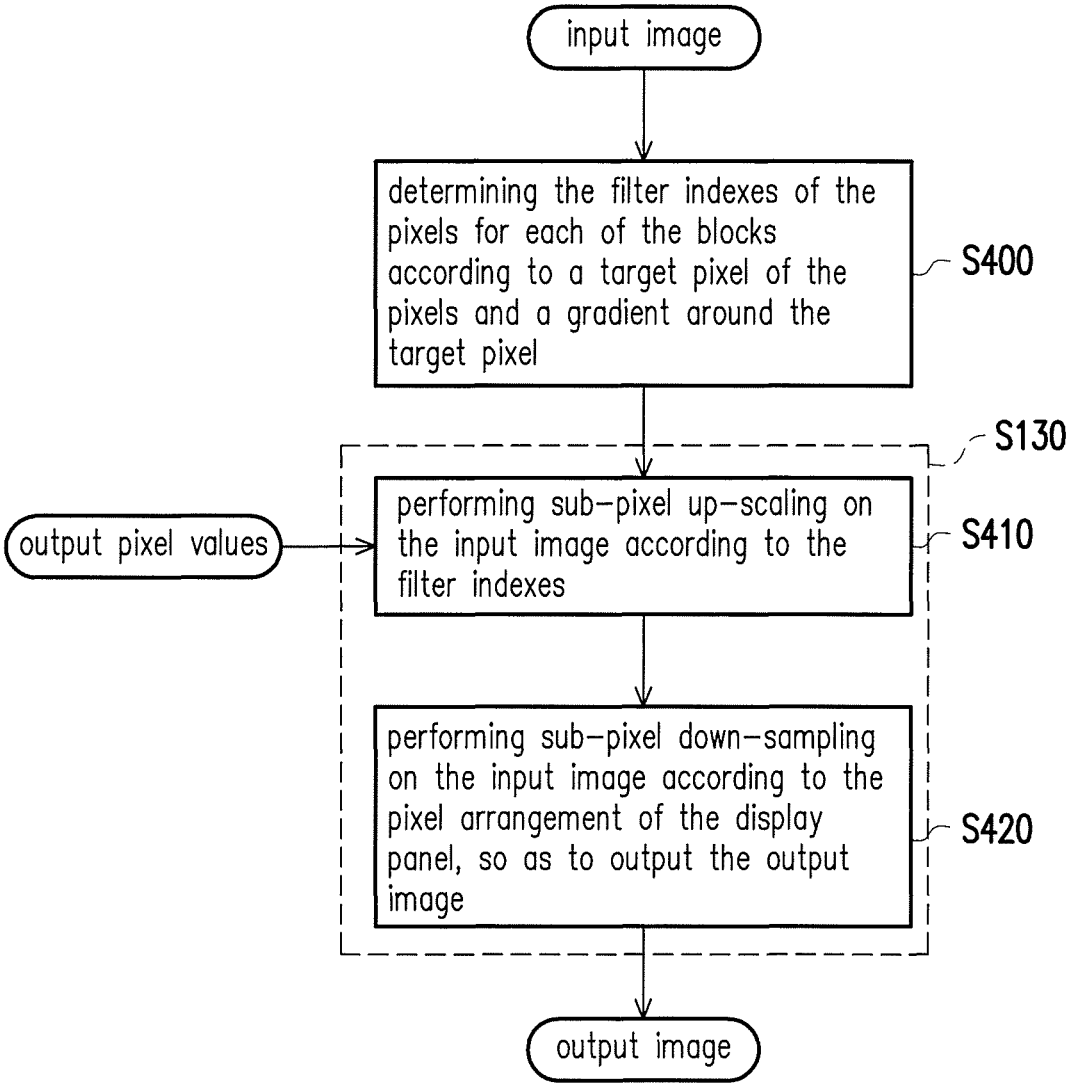
FIG. 6 illustrates a flowchart of a texture analysis method and a sub-pixel adjustment method according to an embodiment of the invention.

FIG. 6 illustrates a flowchart of a texture analysis method and a sub-pixel adjustment method according to an embodiment of the invention. Referring to FIG. 2, FIG. 3 and FIG. 6, the processor unit 110 may respectively perform the texture analysis method and the sub-pixel adjustment method by using the texture analysis module 124 and the sub-pixel adjustment module 128 in this embodiment, for example. In step S120 of FIG. 3, the processor unit 110 performs the texture analysis on the input image Sin based on blocks to determine the filter indexes for the input image Sin. In this embodiment, step S120 may include step S400 to execute the texture analysis method. In step S130 of FIG. 3, the processor unit 110 performs the sub-pixel adjustment on the input image Sin according to the filter indexes and the pixel arrangement of the display panel 200. In this embodiment, step S130 may include steps S410 and S420 to execute the sub-pixel adjustment method.

In step S400, the processor unit 110 determines the filter indexes of the pixels for each of the blocks according to a target pixel of the pixels and a gradient around the target pixel. In this embodiment, each block of the input image Sin may include a 5 by 5 pixel array including 25 pixels, for example. However, the number of the pixels included in each block does not limit the invention. The 25 pixels include the target pixel and pixels around the target pixel. The block based texture analysis is performed to select at least on poly-phase filter for each pixel adaptively. The filter indexes are determined by the gradient around the target pixel. If the target pixel is near an edge, a smoother filter may be selected. By contrast, if the target pixel is located in a smooth region, a sharper filter may be selected. The output of the texture analysis module 124 may include filter indexes configured to select poly-phase filters. Each of the filter indexes is corresponding to a group of filters. The group of filters includes a plurality of poly-phase filters. The selected poly-phase filters may be used in the sub-pixel adjustment module 128. In this embodiment, the filter indexes may include filter indexes of the horizontal direction and filter indexes of the vertical direction.

In step S410, the processor unit 110 performs sub-pixel up-scaling on the input image Sin according to the filter indexes. In this embodiment, a phase number 3 of the horizontal direction and a phase number 1 of the vertical direction for each of the poly-phase filters are further detemiined for each of the poly-phase filters, for example. Next, the sub-pixel up-scaling is performed on the input image Sin in the horizontal direction and the vertical direction by the selected poly-phase filters according to the phase number 3 of the horizontal direction and the phase number 1 of the vertical direction. For example, each pixel including red, green, blue, and white sub-pixels may be up-scaled in horizontal direction by n times, where n is an integer larger than or equal to 1. During the process of up-scaling, the selected poly-phase filter is used to suppress color-fringe, jaggy edge and some other edge errors. For different pixels, different poly-phase filters may be used according to the gradient of the target pixel. The used poly-phase filters are determined by the filter indexes. Accordingly, before sub-pixel rendering, the sub-pixel up-scaling by adaptive poly-phase filters is used for the output pixel values outputted from the color conversion module 126.

In step S420, the processor unit 110 performs sub-pixel down-sampling on the input image Sin according to the pixel arrangement of the display panel 200, so as to output the output image Sout. In this embodiment, the pixels of the display panel 200 are arranged for sub-pixel rendering, and the output image Sout is outputted after step S420 is performed, such that the output image Sout fits the pixel arrangement of the display panel 200. For example, after the sub-pixel up-scaling is performed, one pixel including red, green, blue, and white sub-pixels may be up-scaled to be three pixels that each includes red, green, blue, and white sub-pixels, i.e. totally 12 sub-pixels. For sub-pixel rendering, one pixel of the display panel 200 may include less than 3 sub-pixels. Therefore, the sub-pixel down-sampling is to select proper sub-pixels from the 12 sub-pixels to fit the pixel arrangement of the display panel 200. The output image Sout is outputted to drive the display panel 200, as shown in FIG. 1.

In summary, in exemplary embodiments of the invention, the dynamic brightness control is configured to determine the brightness gain for the input image. The texture analysis is configured to determine filter indexes for the input image. The color conversion with edge protection is performed according to the brightness gain, and the sub-pixel adjustment is perfoimed according to the filter indexes and the pixel arrangement of the display panel. Therefore, the image processing method and the image processing apparatus are capable of providing good image display quality.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An image processing method, comprising:

performing dynamic brightness control on an input image to determine a brightness gain for the input image;

performing texture analysis on the input image based on blocks to determine filter indexes for the input image;

performing color conversion with edge protection on the input image according to the brightness gain; and performing sub-pixel adjustment on the input image according to the filter indexes and a pixel arrangement of a display panel, so as to output an output image, wherein the step of performing the sub-pixel adjustment on the input image comprises:

performing sub-pixel up-scaling on the input image according to the filter indexes; and performing sub-pixel down-sampling on the input image according to the pixel arrangement of the display panel, so as to output the output image.

2. The image processing method according to claim 1, wherein the step of performing the dynamic brightness control on the input image comprises:

converting the input image of a first color space to the input image of a second color space; and analyzing the input image of the second color space to determine the brightness gain.

3. The image processing method according to claim 2, wherein the step of analyzing the input image of the second color space to determine the brightness gain comprises:

grouping pixel values of the input image of the second color space based on a color parameter of the second color space into a plurality of sections; and determining a color gain and a gain weight of each of the sections based on the color parameter to calculate the brightness gain.

4. The image processing method according to claim 1, wherein the input image comprises a plurality of pixels, and the step of performing the color conversion with the edge protection on the input image comprises:

performing the color conversion on the input image to convert the input image of a first color set into the input image of a second color set;

calculating a first gain and a second gain of each of the pixels, wherein at least one of the first gain and the second gain is calculated according to the brightness gain;

performing the edge protection on the first gain and the second gain of each of the pixels to obtain the first gain and the second gain, on which the edge protection has been performed; and calculating output pixel values of each of the pixels according to the obtained first gain, the obtained second gain, and input pixel values of each of the pixels.

5. The image processing method according to claim 4, wherein before the color conversion is performed on the input image, each of the pixels of the input image of the first color set comprises a red sub-pixel, a blue sub-pixel and a green sub-pixel, and after the color conversion is preformed on the input image, each of the pixels of the input image of the second color set comprises the red sub-pixel, the blue sub-pixel, the green sub-pixel and a white sub-pixel.

6. The image processing method according to claim 1, wherein the input image comprises a plurality of blocks, each of the blocks comprises a plurality of pixels, and the step of performing the texture analysis on the input image based on blocks comprises:

determining the filter indexes of the pixels for each of the blocks according to a target pixel of the pixels and a gradient around the target pixel.

7. The image processing method according to claim 6, wherein in the step of determining the filter indexes of the pixels for each of the blocks, a first filter is selected to smooth the target pixel if the target pixel is near an edge, and a second filter is selected to sharp the target pixel if the target pixel is located in a smooth region.

8. The image processing method according to claim 1, wherein each of the filter indexes is corresponding to a group of filters, the group of filters comprises a plurality of poly-phase filters, and the step of performing the sub-pixel up-scaling on the input image comprises:

determining a phase number of a first direction and a phase number of a second direction for each of the poly-phase filters; and performing the sub-pixel up-scaling on the input image in the first direction and the second direction according to the phase number of the first direction and the phase number of the second direction.

9. The image processing method according to claim 1, wherein pixels of the display panel are arranged for sub-pixel rendering, and after the step of performing the sub-pixel down-sampling on the input image is performed, the output image is outputted, and the output image fits the pixel arrangement of the display panel.

10. An image processing apparatus, comprising:

a processor unit performing dynamic brightness control on an input image to determine a brightness gain for the input image, performing texture analysis on the input image based on blocks to determine filter indexes for the input image, performing color conversion with edge protection on the input image according to the brightness gain, and performing sub-pixel adjustment on the input image according to the filter indexes and a pixel arrangement of a display panel, so as to output an output image, wherein when the processor unit performs the sub-pixel adjustment on the input image, the processor unit performs sub-pixel up-scaling on the input image according to the filter indexes, and performs sub-pixel down-sampling on the input image according to the pixel arrangement of the display panel, so as to output the output image.

11. The image processing apparatus according to claim 10, wherein when the processor unit performs the dynamic brightness control on the input image, the processor unit converts the input image of a first color space to the input image of a second color space, and analyses the input image of the second color space to determine the brightness gain.

12. The image processing apparatus according to claim 11, wherein when the processor unit analyses the input image of the second color space to determine the brightness gain, the processor unit groups pixel values of the input image of the second color space based on a color parameter of the second color space into a plurality of sections, and determines a color gain and a gain weight of each of the sections based on the color parameter to calculate the brightness gain.

13. The image processing apparatus according to claim 10, wherein the input image comprises a plurality of pixels, and when the processor unit performs the color conversion with the edge protection on the input image, the processor unit performs the color conversion on the input image to convert the input image of a first color set into the input image of a second color set, calculates a first gain and a second gain of each of the pixels gain, performs the edge protection on the first gain and the second gain of each of the pixels to obtain the first gain and the second gain, on which the edge protection has been performed, and calculates output pixel values of each of the pixels according to the obtained first gain, the obtained second gain, and input pixel values of each of the pixels, wherein at least one of the first gain and the second gain is calculated according to the brightness.

14. The image processing apparatus according to claim 13, wherein before the color conversion is performed on the input image, each of the pixels of the input image of the first color set comprises a red sub-pixel, a blue sub-pixel and a green sub-pixel, and after the color conversion is performed on the input image, each of the pixels of the input image of the second color set comprises the red sub-pixel, the blue sub-pixel, the green sub-pixel and a white sub-pixel.

15. The image processing apparatus according to claim 10, wherein the input image comprises a plurality of blocks, each of the blocks comprises a plurality of pixels, and when the processor unit performs the texture analysis on the input image based on blocks, the processor unit determines the filter indexes of the pixels for each of the blocks according to a target pixel of the pixels and a gradient around the target pixel.

16. The image processing apparatus according to claim 15, wherein when the processor unit determines the filter indexes of the pixels for each of the blocks, a first filter is selected to smooth the target pixel if the target pixel is near an edge, and a second filter is selected to sharp the target pixel if the target pixel is located in a smooth region.

17. The image processing apparatus according to claim 10, wherein each of the filter indexes is corresponding to a group of filters, the group of filters comprises a plurality of poly-phase filters, and when the processor unit performs the sub-pixel up-scaling on the input image, the processor unit determines a phase number of a first direction and a phase number of a second direction for each of the poly-phase filters, and performs the sub-pixel up-scaling on the input image in the first direction and the second direction according to the phase number of the first direction and the phase number of the second direction.

18. The image processing apparatus according to claim 10, wherein pixels of the display panel is arranged for sub-pixel rendering, and after the processor unit performs the sub-pixel down-sampling on the input image, the output image is outputted, and the output image fits the pixel arrangement of the display panel.

* * * * *